US007540623B2

(12) United States Patent
Petzl et al.

(10) Patent No.: US 7,540,623 B2
(45) Date of Patent: Jun. 2, 2009

(54) ELECTRIC TORCH-LIGHT EQUIPPED WITH A DEVICE FOR FIXING AND POSITIONING ON A SUPPORT

(75) Inventors: Paul Petzl, Barraux (FR); Raphael Bortolotti, Crolles (FR)

(73) Assignee: ZEDEL, Crolles (FR)

( * ) Notice: Subject to any disclaimer, the term of this patent is extended or adjusted under 35 U.S.C. 154(b) by 118 days.

(21) Appl. No.: 11/641,683

(22) Filed: Dec. 20, 2006

(65) Prior Publication Data

US 2007/0177375 A1 Aug. 2, 2007

(30) Foreign Application Priority Data

Jan. 27, 2006 (FR) ..... 06 00820

(51) Int. Cl.
*F21L 2/00* (2006.01)

(52) U.S. Cl. ..... 362/197; 362/190; 362/191; 362/269; 362/427

(58) Field of Classification Search ..... 362/103, 362/108, 157, 190, 191, 197, 269, 396, 398, 362/427; 36/137
See application file for complete search history.

(56) References Cited

U.S. PATENT DOCUMENTS

| | | | |
|---|---|---|---|
| 5,738,432 | A | 4/1998 | Okko et al. |
| 2004/0064871 | A1 | 4/2004 | Schlapkohl |
| 2004/0252494 | A1 | 12/2004 | Parsons et al. |

*Primary Examiner*—Sandra L O'Shea
*Assistant Examiner*—Meghan K Dunwiddie
(74) *Attorney, Agent, or Firm*—Oliff & Berridge, PLC

(57) ABSTRACT

A fixing and positioning device for a torch-light comprises a slide associated with retaining means integral to an actuating part movable between a latched position and an unlatched position, and a male coupling insertable in the guide. The coupling is provided with an annular notched crown-wheel so as to form a mechanical clipping connection enabling an angular orientation with indexing of the torch-light with respect to the support.

8 Claims, 6 Drawing Sheets

ELECTRIC TORCH-LIGHT EQUIPPED WITH A DEVICE FOR FIXING AND POSITIONING ON A SUPPORT

BACKGROUND OF THE INVENTION

The invention relates to an electric torch-light housed in a casing, comprising lighting means supplied by an electric power source. A device for fixing and positioning the casing on a support comprises a guide in which a coupling means is engaged to form a mechanical connection, and an annular notched crown-wheel enabling angular orientation of the torch-light with respect to the support.

STATE OF THE ART

For multidirectional orientation of a torch-light, it is known to fix the torch-light on a support plate that is able to be oriented by means of a socket joint securedly fixed to a support in the form of a grip.

According to another known device, the fixing plate of the torch-light is mounted swivelling around a horizontal spindle fixed to the support. The latter is formed by the base of a cap with elastic retaining straps, and the orientation movement of the torch-light can only be exerted in the upwards direction.

The document U.S. Pat. No. 5,738,432 describes a torch-light with multiple orientation and that can be fitted onto any type of support. It comprises a plate that is able to be engaged by sliding in a guide of a support, said plate being joined to the torch-light by a first swivelling link making the torch-light swivel upwards around a horizontal axis, and by a second notched crown-wheel link enabling angular orientation of the torch-light around a vertical axis. Adjustment in rotation is performed by means of a lever making the crown-wheel rotate around the vertical axis. The dimensions of such a mechanism comprising several connecting links do however remain large.

OBJECT OF THE INVENTION

The object of the invention is to provide a torch-light that can be fitted on any type of support, having a beam whose orientation is able to be adjusted and small dimensions.

The torch according to the invention is characterized in that the notched crown-wheel of the coupling means is integral to the support and is provided with a rim designed to slide in the guide arranged in the casing, and that a flexible actuating part extends along the guide and bears a clipping pin co-operating in the latched position with the notches of the crown-wheel.

Such a mechanical link enables a twofold clipping and angular orientation function to be achieved within a minimum volume.

According to a preferred embodiment, the notched crown-wheel of the coupling means is arranged inside a cylindrical sleeve integral to the support. The retaining tab bearing the clipping pin advantageously forms a latch after it has passed over the rim.

Preferably, the clipping pin is shaped as a pyramidal stud allowing an incremental rotary movement on the different notches of the crown-wheel.

The guide and the retaining tab are preferably located on a support plate articulated on the casing so as to direct the torch-light in the upwards direction, and vice-versa. The articulation axis of the support plate is orthogonal to the axis of the notched crown-wheel of the coupling means.

The clipping pin and the retaining means on the actuating element can be formed by one or two distinct separate parts.

BRIEF DESCRIPTION OF THE DRAWINGS

Other advantages and features will become more clearly apparent from the following description of an embodiment of the invention, given as a non-restrictive example only, and represented in the accompanying drawings, in which.

DESCRIPTION OF A PREFERRED EMBODIMENT

Figure 1:
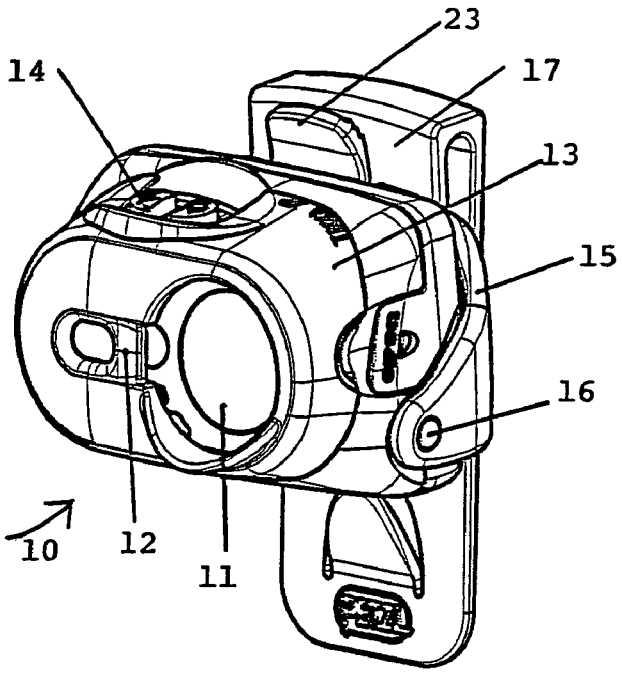
FIGS. 1 and 2 show perspective views of a torch-light fixed to the support in two angular positions.
Figure 2:
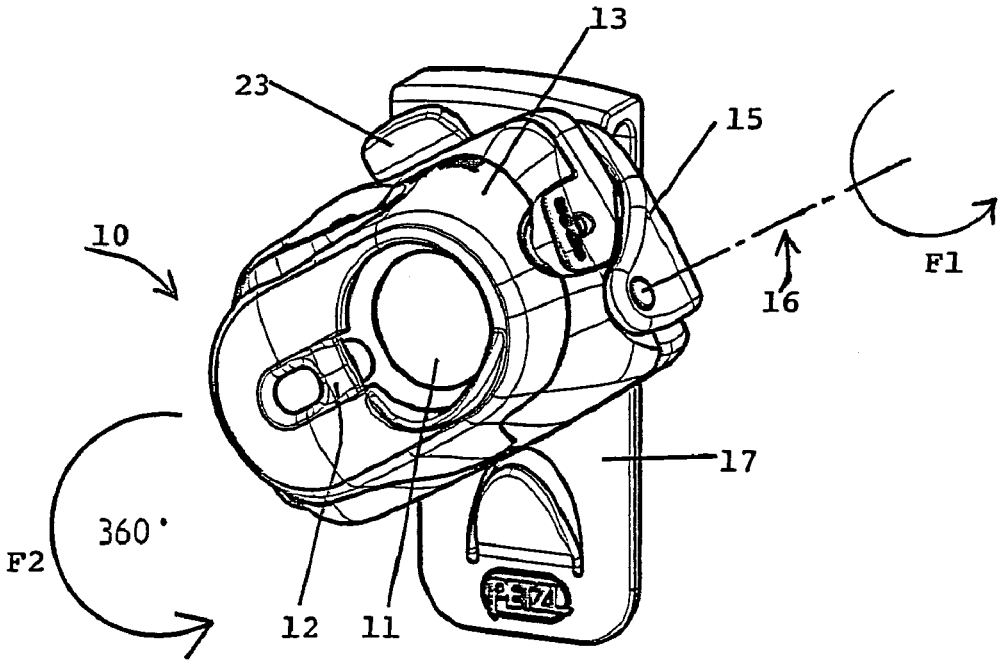
Figure 3:
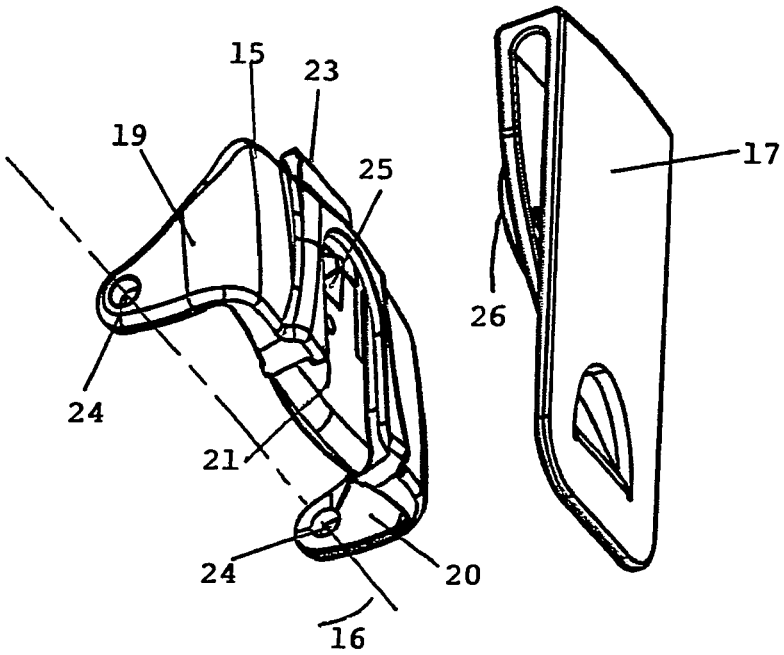
FIG. 3 is a perspective view of the support plate equipped with the guide and retaining tab before coupling on the support.

In FIGS. 1 and 2, an electric lighting torch-light 10 comprises an optical system 11 composed of a power LED and a focussing lens 12 in the form of a sliding shutter. When the shutter is open, the lighting beam coming from the LED enables long-range vision to be had. When the shutter is closed being moved in front of the LED, the beam is wide for close-range vision. The LED is supplied by an electric power source, in particular disposable or rechargeable batteries, the assembly being housed in a casing 13 equipped with control and selection buttons 14.

The casing 13 is mounted swivelling on a support plate 15 so as to be able to direct the torch-light 10 in the upwards direction around an articulation axis 16 (see arrow F1).

The support plate 15 is itself connected to a support 17 by a mechanical connection performing a twofold function of clipping and angular orientation in the direction of the arrow F2.

The two orientation movements of the torch-light 10 in the direction of the arrows F1 and F2 are distinct and orthogonal, that of swivelling of the casing 13 around the axis 16 being limited and less than 90°, and the other of rotation of the assembly formed by the torch-light 10 and support plate 15 being adjustable by incrementation through 360° around an axis perpendicular to the support 17.

With reference to FIGS. 3 to 8, the U-shaped support plate 15 comprises a central body 18 perpendicular to two end branches 19, 20. Outside the U, the body 18 is provided with a guide 21 in which there extends an actuating part 22 in the form of a tab movable between a latched position and an unlatched position. The top end acts as gripping lug 23 to unlatch the mechanical connection with the support 17. The two end branches 19, 20 of the support plate 15 are provided with support bearings 24 aligned in the direction of the articulation axis 16 of the torch-light 10. The casing 13 is provided for this purpose with two half-spindles inserted in the support bearings 24 of the support plate 15. The actuating part 22 is provided with a clipping pin (FIGS. 3 and 7) situated near to the bottom of the guide 21 and shaped as a pyramidal stud with oblique faces.

The support 17 for clipping-on the assembly formed by the torch-light 10 and support plate 15 can be of any shape and have various fixing means depending on the required use, in particular for a cap with elastic retaining straps, a helmet, or any other accessory. In the example of FIGS. 3 to 5 and 9, the support 17 is formed by a hook designed to be hooked in removable manner onto an object, for example the crown of a helmet. The hook is made by moulding a plastic material and is deformable by elasticity when it is fitted onto the object.

The external face 29 of the support 17 arranged facing the guide 21 is equipped with a male coupling part 26 designed to come into engagement with the clipping pin 25 to form the mechanical connection with the support plate 15. The coupling part 26 (see FIG. 4) comprises a cylindrical sleeve salient from the external face 29 and provided with a rim 27 of slightly larger diameter. The inside of the sleeve is shaped as a blind hole provided with an annular notched crown-wheel 28. The notches of the crown-wheel 28 are arranged angularly at regular intervals around the circumference and co-operate with the clipping pin 25 to perform indexing. A predetermined angular position of the assembly formed by the torch-light 10 and support plate 15 corresponds to each notch when incremental rotary movement of the assembly is performed in the direction of the arrow F2 (FIG. 2).

To couple the assembly formed by the torch-light 10 and support plate 15 to the support 17, the guide 21 of the support plate 15 simply has to be slid onto the cylindrical sleeve of the coupling part 26. The retaining part 22 is slightly deformed by elasticity in an intermediate position to allow the clipping pin 25 to pass over the rim 27. At the end of insertion travel, the clipping pin 25 engages in a notch of the crown-wheel 28, making the mechanical coupling connection to the support 17. The flexible actuating part 22 and the clipping pin 25 form a latch.

The clipping pin 25 and the retaining means on the actuating part 22 are formed by one and the same part.

Figure 4:
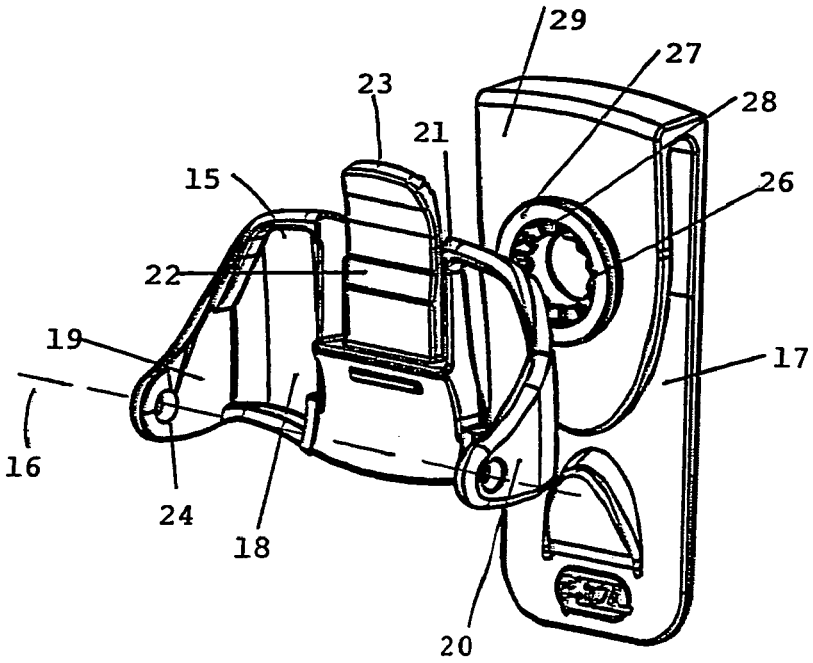
FIG. 4 is perspective view of FIG. 3, shifted through 90°, illustrating the female coupling part on the support.
Figure 5:
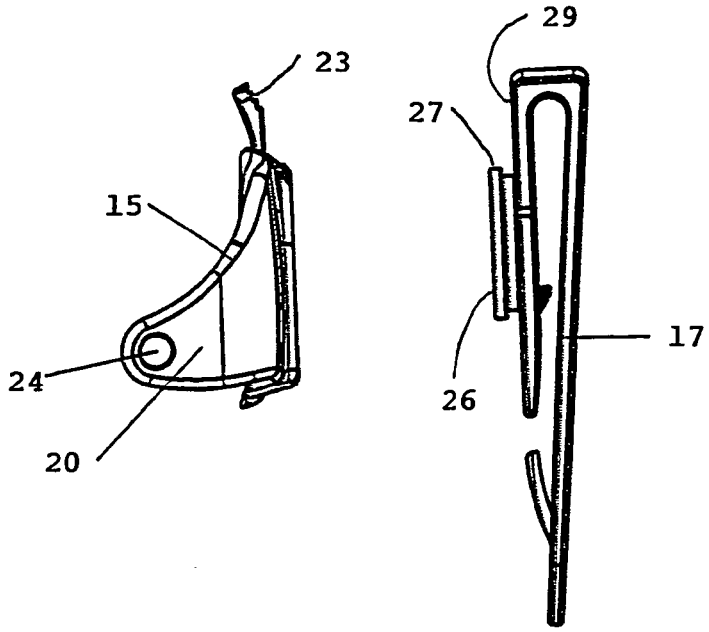
FIG. 5 represents a side view of FIG. 3.
Figure 6:
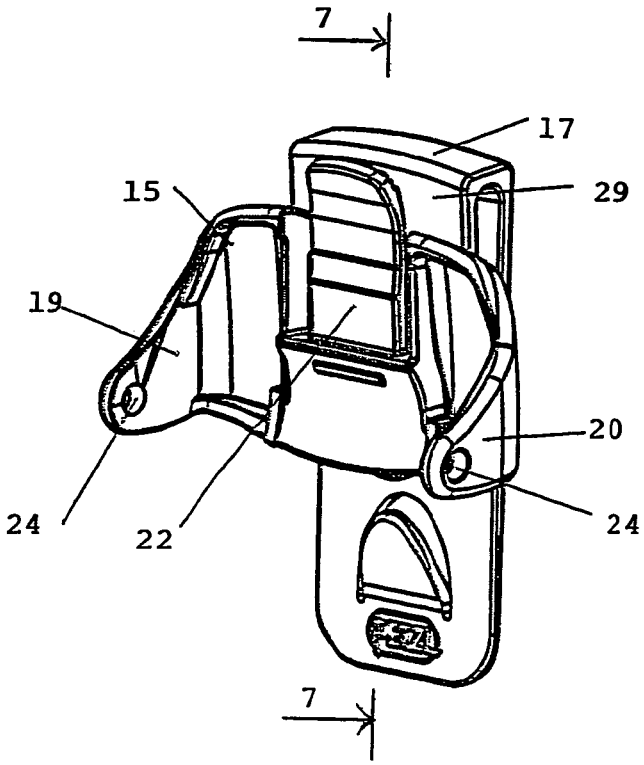
FIG. 6 is an identical view to FIG. 4 after the support plate and the support have been assembled.
Figure 7:
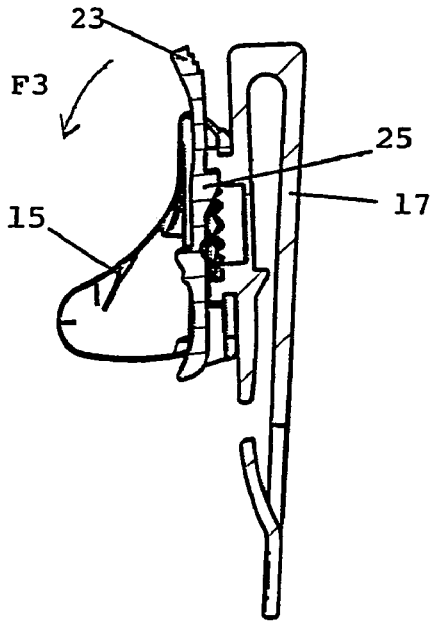
FIG. 7 shows a vertical cross-sectional view along the line 7-7 of FIG. 6.
Figure 8:
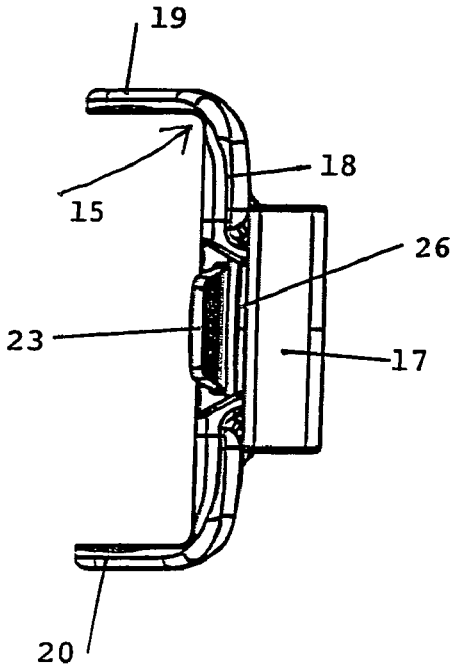
FIG. 8 is a plan view of FIG. 6.
Figure 9:
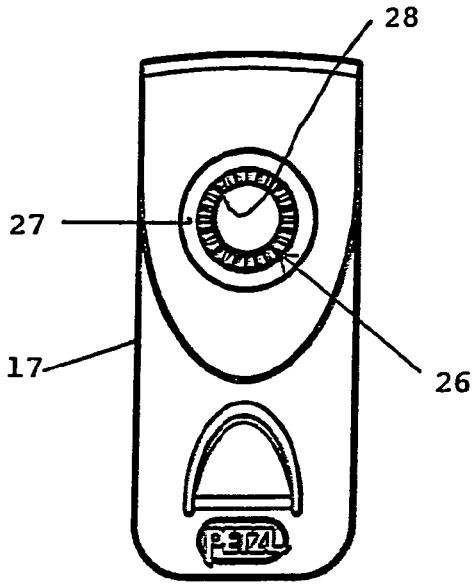
FIG. 9 represents a front view of FIG. 4.

In the example of FIG. 4, the male coupling part 26 comprises a crown-wheel 28 with twelve notches. In the assembled position of the clipping pin 25 in the coupling part 26, the angular positioning of the torch-light 10 can be chosen by rotating the assembly formed by the torch-light 10 and the support plate 15 (arrow F2, FIG. 4) with respect to the support 17. The pin 25 moves step by step between the successive notches by regular angular increments of 30°.

The torch-light 10 and support plate 15 assembly can easily be removed from the support 17 after the clipping pin 25 has been unlatched. The gripping lug 23 simply has to be swivelled in the direction of the arrow F3 (FIG. 7) to release the clipping pin 25 from the notch of the crown-wheel 28. The inactive ratchet releases the male coupling part 26 and enables the torch-light 10 and support plate 15 assembly to be removed.

A single torch-light 10 associated with its support plate 15 can in this way easily be fitted onto different supports 17.

According to an alternative embodiment, the guide 21 and the retaining tab 22 with its clipping pin 25 could be arranged directly on the rear face of the casing 13 of the torch-light 10. The support plate 15 able to be oriented in the upwards direction is then eliminated, and the torch-light 10 would only be movable in angular orientation by incrementation in the direction of the arrow F2 of FIG. 2.

Figure 10:
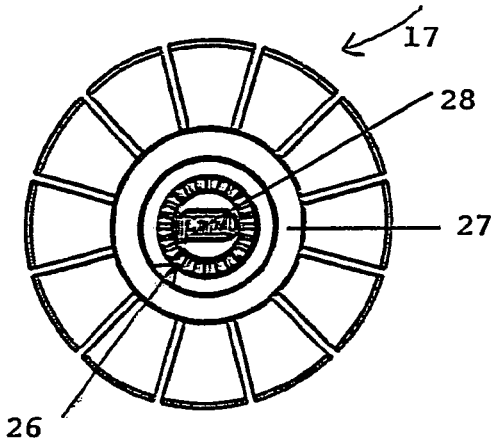
FIGS. 10 and 11 are identical views to FIG. 9 of two alternative embodiments.

According to FIG. 10, the support 17 is round in shape and comprises a self-adhesive face opposite the coupling part 26.

Figure 11:
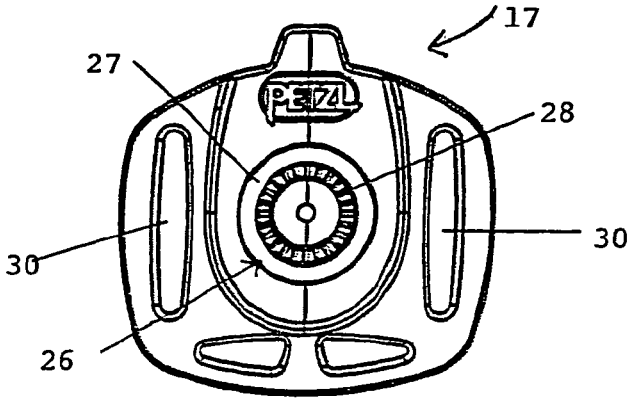

With reference to FIG. 11, the support 17 comprises two slots 30 enabling an elastic band or a winder to be attached.

Figure 12:
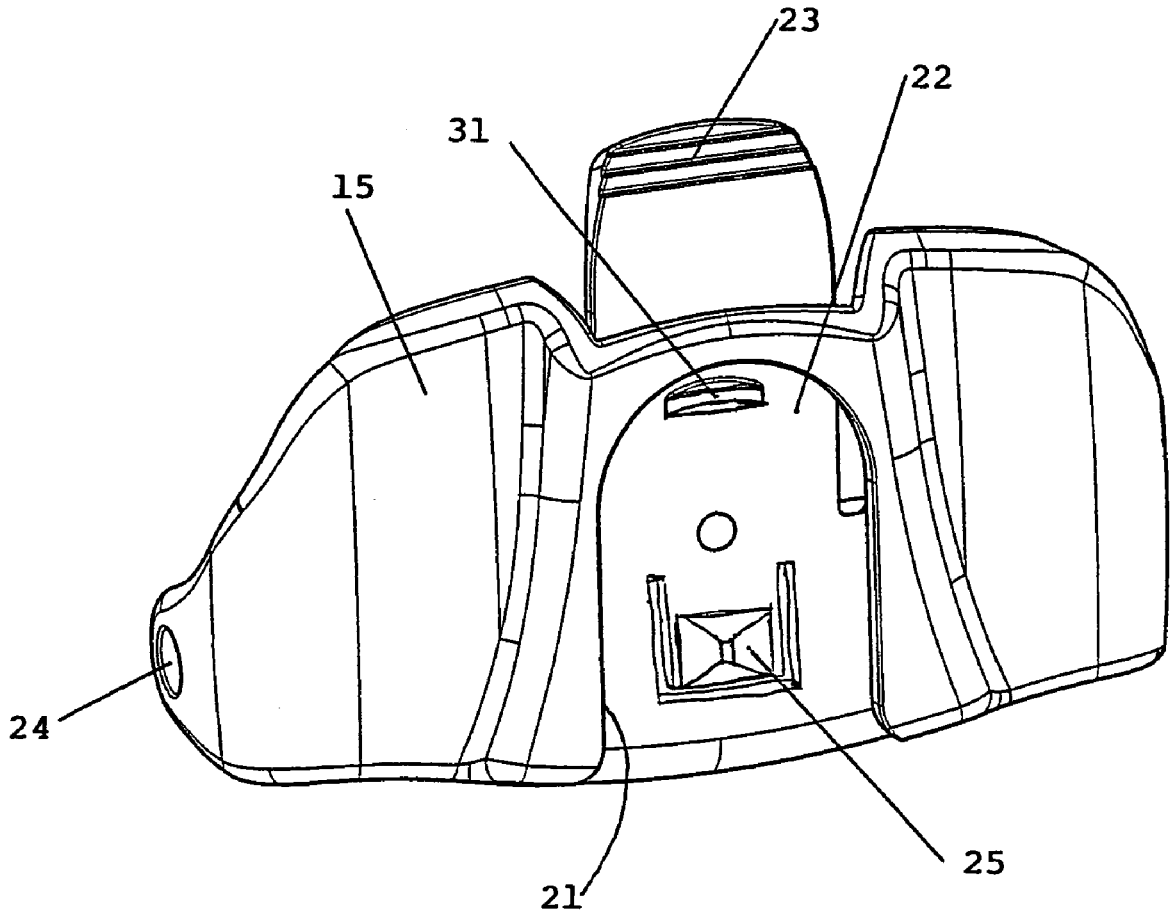
FIG. 12 is a perspective view of an alternative embodiment of the support plate with the clipping pin and the retaining means formed by two distinct parts on the actuating element.

In FIG. 12, the guide 21 and the actuating part 22 are located on the support plate 15 articulated on the casing. The clipping pin 25 and the retaining means 31 are formed by two distinct parts on the actuating part 22.

The invention claimed is:

1. An electric torch-light apparatus useable with a source of electric power, comprising:

a casing;

an electric torch-light housed in the casing and including a light supplied by the electric power source; and a device for fixing and positioning the casing on a support, the device including:

a coupling element on the support that includes an annular notched crown-wheel integral with the support that enables angular orientation of the torch-light with respect to the support;

a guide arranged on the casing and configured to engage the coupling element to form a mechanical link therebetween;

wherein the annular notched crown-wheel is provided with a rim that is configured to slide in the guide;

a flexible actuating part that extends along the guide; and a clipping pin connected to the flexible actuating part, the clipping pin being configured to engage the notched crown-wheel in a latched position.

2. The electric torch-light apparatus according to claim 1, wherein the clipping pin is shaped as a pyramidal stud and allows an incremental rotary movement on different notches of the crown-wheel.

3. The electric torch-light apparatus according to claim 1, wherein the guide and the actuating part are located on a support plate arranged on the casing and moveable about a swivel axis so as to direct the torch-light in an upwards direction and a downwards direction.

4. The electric torch-light apparatus according to claim 3, wherein the swivel axis of the support plate is orthogonal to the axis of the notched crown-wheel of the coupling element.

5. The electric torch-light apparatus according to claim 1, wherein the support is in the form of a hook.

6. The electric torch-light apparatus according to claim 1, wherein the support comprises a base connected to a cap with elastic retaining straps.

7. The electric torch-light apparatus according to claim 1, wherein the support comprises a base having a face provided with a self-adhesive coating opposite the coupling element.

8. A device for fixing and positioning a casing on a support, an electric torch-light being housed in the casing and including a light supplied by an electric power source, the device comprising:

a coupling element on the support that includes an annular notched crown-wheel integral with the support that enables angular orientation of the torch-light with respect to the support;

a guide arranged on the casing and configured to engage the coupling element to form a mechanical link therebetween;

wherein the annular notched crown-wheel is provided with a rim that is configured to slide in the guide;

a flexible actuating part that extends along the guide; and a clipping pin connected to the flexible actuating part, the clipping pin being configured to engage the notched crown-wheel in a latched position.

* * * * *